United States Patent [19]

Fortin et al.

[11] 4,121,951

[45] Oct. 24, 1978

[54] ALUMINUM ALLOY ELECTRICAL CONDUCTOR AND METHOD THEREFOR

[75] Inventors: Paul Emile Fortin; Fred Howitt, both of Kingston, Canada

[73] Assignee: Alcan Research and Development Limited, Montreal, Canada

[21] Appl. No.: 664,306

[22] Filed: Mar. 5, 1976

[51] Int. Cl.[2] ..... C22F 1/04

[52] U.S. Cl. ..... 148/12.7 A; 75/142; 75/147; 148/32.5; 148/159

[58] Field of Search ..... 148/2, 32.5, 12.7, 1, 148/159; 75/138, 142, 147, 148; 174/23

[56] References Cited

U.S. PATENT DOCUMENTS

| | | | |
|---|---|---|---|
| 2,572,562 | 10/1951 | Harrington | 75/147 |
| 3,196,528 | 7/1965 | Broverman et al. | 75/138 |
| 3,278,300 | 10/1966 | Koike | 75/138 |
| 3,694,195 | 9/1972 | Yokota | 75/138 |
| 3,852,122 | 12/1974 | Aarflot et al. | 148/159 |
| 3,914,009 | 10/1975 | Chia et al. | 148/2 |
| 3,920,411 | 11/1975 | Schoerner et al. | 148/2 |

FOREIGN PATENT DOCUMENTS

| | | | |
|---|---|---|---|
| 261,992 | 7/1959 | Japan | 75/138 |
| 34-6,603 | 2/1959 | Japan | 75/138 |

OTHER PUBLICATIONS

Constitution of Binary Alloys, Hansen, McGraw Hill Book Co. Inc., N.Y., 1958, pp. 152, 153.

*Primary Examiner*—R. Dean

*Attorney, Agent, or Firm*—Cooper, Dunham, Clark, Griffin & Moran

[57] ABSTRACT

An aluminum alloy electrical conductor consisting essentially of 0.07 – 0.2% Mg, 0.02 – 0.05% Zr, balance Al with minor amounts of other elements, annealed at 200° – 300° C to precipitate $ZrAl_3$ and having an electrical conductivity of at least 60% IACS.

4 Claims, No Drawings

ALUMINUM ALLOY ELECTRICAL CONDUCTOR AND METHOD THEREFOR

BACKGROUND OF THE INVENTION

This invention relates to aluminum alloy electrical conductors. Examples of such conductors are wire, transformer strip, and the like.

Commercial purity aluminum has been employed as an electrical conductor for a long period and is increasingly replacing copper for that purpose. For reasons of economy, it is always necessary to employ a grade of aluminum having as high a conductivity as possible, consistent with the mechanical strength necessary to perform its function and also consistent with cost.

While very pure grades of aluminum may have a conductivity of 63.5 - 65% of the conductivity of pure annealed copper, the mechanical strength of the metal is unacceptably low. Electrical conductor (E.C.) grade aluminum commonly has a conductivity of 61.0 - 63.5% of the conductivity of copper and is a commercial purity aluminum generally containing 0.15 - 0.40% Fe and below 0.10% Si as the main impurities. Other impurities are maintained at a low value. An illustrative specification for E.C. grade aluminum alloy is as follows: less than 0.04% Cu, 0.15 - 0.40% Fe, 0.10% max. Si, 0.02% max. Zn, 0.02% max B, 0.02% max. Ga, and other elements less than 0.010% each, with a minimum Al content of 99.45%. It will be understood that all percentages set forth herein are expressed as percent by weight unless otherwise specifically indicated.

Increase in the levels of impurities and alloying elements leads to reductions in the conductivity of the metal.

The major obstacle to the use of aluminum wire for general electrical purposes is the uncertainty and difficulty of making stable, low-resistance connections. The surface of aluminum is normally protected by a film of oxide which is highly refractory and electrically insulating. Where this film remains between the contact faces, it increases the electrical resistance of the connections. Moreover, the aluminum alloys in common use for conductor wire, being close to the pure metal, soften relatively rapidly with rise in temperature and have poor creep resistance. Because of this, even where an adequate contact is established initially, it may not remain so, because of relaxation of the contact pressure, and the contact resistance will tend to increase for this reason.

When a current is passed through a contact having inadequate contact pressure, heat energy is liberated, chiefly at the points of high resistance at the contact faces, and causes a rise in temperature. This causes thermal expansion to take place, chiefly in the aluminum wire. It also produces softening of the wire and increase in the creep, with corresponding reduction in contact pressure and still further increase in resistance.

This process is cumulative and even if the contact faces are clean and free from oxide initially, at some stage it is possible for air to gain access to the contact faces and cause oxidation, particularly under intermittent operation, resulting in rapid and complete failure of the connection.

In order to provide an aluminum wire which is less subject to the above-indicated difficulties and thus rendered more suitable for general electrical wiring purposes, it is necessary both to increase its creep resistance and also to increase its thermal stability, i.e. to reduce its tendency to soften with slight temperature rise, such as typically occurs in connections in domestic electrical wiring.

Bearing in mind the importance of maintaining the conductivity of the aluminum at as high a level as possible, alloying additions for the purpose of increasing creep resistance and reducing the tendency of the metal to soften with temperature increase are maintained at as low a level as is consistent with these objectives.

For many purposes, the minimum acceptable conductivity of aluminum conductors is 60% of the International Annealed Copper Standard (IACS). Since alloying additions, especially such as might provide improvement with respect to creep and softening, generally tend to reduce conductivity, the difficulty of achieving a conductor that possesses both adequate conductivity and satisfactory creep resistance and thermal stability has heretofore limited use of aluminum conductors.

SUMMARY OF THE INVENTION

The present invention broadly contemplates the provision of an electrical conductor constituted of an alloy consisting essentially of 0.07 - 0.2% magnesium, 0.02 - 0.05% zirconium, balance aluminum containing not more than 0.15% silicon and not more than minor amounts of other elements, the conductor being in a condition produced by at least partial annealing at a temperature of 200° - 300° C. for a period of time sufficient to precipitate $ZrAl_3$ and having a conductivity of at least 60% IACS.

It is found that conductors in accordance with the invention, while satisfying the widely required minimum value of conductivity, also exhibit very markedly superior creep resistance and reduction in softening tendency as compared with conventional E.C. grade aluminum conductors, and are therefore capable of use in many situations in which the latter conductors are less satisfactory or even wholly unacceptable. The improvement with respect to creep resistance and thermal stability achieved by the present invention is believed attributable to the inclusion of Zr and Mg in the stated amounts; thus, in particular, the enhanced thermal stability results from the effect of Zr in raising the recrystallization temperature of the alloy, while the Mg addition increases creep resistance. Observance of the specified upper limits of Zr and Mg content, and also the precipitation of $ZrAl_3$ by annealing, contribute to attainment of the high conductivity levels achieved.

Further features and advantages of the invention will be apparent from the detailed description hereinbelow set forth.

DETAILED DESCRIPTION

In accordance with the invention, an electrical conductor (such as wire, transformer strip, or the like) is constituted of an alloy having the following composition:

0.07 - 0.2% magnesium;

0.02 - 0.05% zirconium;

balance aluminum containing not more than 0.15% Si, not more than 1.0% Fe, not more than 0.31% Cu (depending on the Mg content of the final alloy, as explained below), not more than 0.2% Zn, not more than 0.05% each of B and Ga, not more than 0.01% each of Ti, V, Mn and Cr, others not more than 0.03% each, 0.10% total. More specifically, the upper limit for Cu is $[0.05 + 2(0.2 - m)]\%$ where $m$ is the percent content of magnesium in the final alloy; thus if $m = 0.2\%$, the maximum Cu content is 0.05%, but if $m = 0.07\%$, the maximum Cu content is $0.05 + 2(0.2 - 0.07) = 0.31\%$.

The maxima for impurities and/or additions, in the aluminum with which Mg and Zr are alloyed in accordance with the invention, are selected as values which will not prevent attainment of the requisite electrical conductivity in the conductor product of the invention. To this end, it is particularly important to minimize the content of Ti, V, Mn and Cr, owing to their known adverse effect on conductivity; while any one of these elements may be present in the aluminum up to the above-stated 0.01% maximum, in such case the others of these elements should be well below that maximum. Stated generally, it is desirable that the aluminum include some minor amount of impurities such as iron which contribute to the strength of the conductor product, as in the case of conventional E.C. grade aluminum; however, in its broader aspects the invention also embraces alloys wherein the aluminum content is of extremely high purity, i.e. the advantages of the invention may be realized in substantial measure by alloying Mg and Zr in the stated proportions even with superpurity aluminum. Preferred limiting values of impurities and/or additions in the aluminum content of the alloys of the present invention are as follows:

| | Maximum or Range (%) |
|---|---|
| Si | 0.10 |
| Fe | 0.05 - 0.60 |
| Cu, Zn | 0.05 each |
| B, Ga | 0.02 each |
| Ti, V, Mn, Cr | 0.005 each |
| Others | 0.01 each / 0.10 total |

One specific illustrative example of an alloy composition in accordance with the present invention is as follows:

| | Maximum or range (%) |
|---|---|
| Mg | 0.07 - 0.2 |
| Zr | 0.02 - 0.05 |
| Fe | 0.15 - 0.40 |
| Cu | 0.04 |
| Si | 0.10 |
| Zn, B, Ga | 0.02 each |
| Others | 0.01 each |
| Al | balance |

This alloy may be prepared by combining Mg and Zr in the stated proportions with an E.C. grade aluminum of the illustrative type referred to above, viz. 99.45% purity Al containing impurities in the amounts indicated above.

The alloy as described above is subjected to operations such as drawing or rolling, e.g. of conventional character and ordinarily including substantial cold working, to produce the desired wire or other conductor. Since the stability of the physical properties of cold-worked aluminum may be disturbed by heat generated in a conductor such as a wire and particularly in a poorly formed connection, the wrought conductor is subjected to a partial or full annealing treatment. Moreover, at least partial annealing is essential to assure attainment of a minimum electrical conductivity of at least 60% IACS. Further in accordance with the invention, this annealing treatment is performed as a batch anneal wherein the time and temperature conditions are such as to effect sufficient precipitation of $ZrAl_3$ to attain a conductivity of at least 60% IACS. Specifically, the requisite precipitation of $ZrAl_3$ is achieved by annealing the conductor at a temperature of between about 200° and about 300° C. (preferably about 225° to about 275° C.) for a period of at least about 10 minutes (preferably about one to about 24 hours).

In this regard, it may be explained that prior to the annealing treatment, the Zr content of the present alloy is essentially all in solid solution; but since the amount of Zr in the alloy exceeds that which would normally be in solution, at least at temperatures up to 300° C., this is in the nature of a supersaturated solution. While the Zr present in solid solution enhances the thermal stability of the alloy, it also reduces the conductivity of the alloy. Upon annealing as described above in the specified temperature range, at least some of the excess Zr in solid solution precipitates in very fine particles of $ZrAl_3$, thereby raising the conductivity of the alloy; yet, as a present believed, the fine precipitate (as well as the Zr remaining in solid solution) contributes to the thermal stability of the alloy. It is also believed that the improved creep resistance afforded by the invention is attributable to the presence of Mg in solid solution. In the course of the annealing step, some of the Mg combines with Si, which is virtually always present as an impurity, to form some $Mg_2Si$ precipitate, but sufficient Mg remains in solid solution to provide the desired enhancement of creep resistance.

At annealing temperature below 200° C., diffusion of metallic atoms is slow and precipitation takes excessively long. On the other hand, at temperatures higher than 300° C., the solid solubility limits are higher and again the amount of precipitation is reduced. Thus continuous annealing (with a very short time at high temperature), although otherwise satisfactory for annealing an alloy such as is employed in the present invention, is not suitable to increase the conductivity to over 60% IACS because of the high temperatures and short times involved. Within the stated 200° - 300° C. temperature range, however, batch annealing can effect sufficient precipitation of $ZrAl_3$ to achieve the requisite conductivity in a practicable time period. This is illustrated by the following table, which sets forth results obtained with successive samples of the same conductor wire constituted of an alloy in accordance with the invention:

Table 1

| Annealing | | 0.2% Yield | |
|---|---|---|---|
| Temp. (° C) | Time (hrs.) | Strength (p.s.i. × 1000) | Conductivity (% IACS) |
| - as drawn - | | 29.4 | 58.55 |
| 200 | 5 | 24.0 | 60.14 |
| 225 | 5 | 20.7 | 60.36 |
| 250 | 5 | 16.6 | 60.58 |
| 275 | 5 | 13.8 | 60.57 |
| 300 | 5 | 9.5 | 60.43 |
| 350 | 5 | 8.3 | 59.38 |
| 350 | 1/30 | 9.8 | 59.30 |
| 350 | 1/6 | 8.4 | 59.32 |

After annealing, the wire or other conductor is desirably or preferably subjected to further treatment (as by a conventional cleaning process, e.g. immersion in hot, strong sulfuric acid solution, or mechanical abrasion) for removal of the oxide film that tends to form on the conductor surface, i.e. to avoid the high contact resistance that might result from the presence of such film.

Also, if desired to protect the surface of the cleaned conductor against the regrowth of oxide film, the conductor may be plated with one of a number of different metals, such as Cu or Ni or other common plating metals such as Cd or Sn, which maintain a relatively oxide-free surface.

To illustrate further the properties and advantages of the invention, a detailed comparison has been made of 0.081-inch-diameter electrical conductor wires respectively constituted of the following alloys:

Alloy A: an E.C, grade aluminum containing 0.23% Fe, 0,07% Si, 0.025% Cu and other minor impurities in permitted amounts;

Alloy B: an alloy in accordance with the present invention containing 0.26% Fe, 0.07% Si, 0.033% Cu, and other minor impurities in permitted amount for E.C. grade aluminum alloyed with 0.17% Mg and 0.04% Zr.

The tensile and conductivity values for wires respectively constituted of these two alloys are indicated in Table 2 below, which lists the values of the mechanical properties and electrical conductivity of lengths of wire of the two alloys, measured at 20° C. after annealing for either 5 or 24 hours at the indicated temperature.

Table 2

Tensile and Conductivity Values of Alloys A and B

| Annealing Treatment | | Ultimate Tensile Strength (p.s.i.× 1000) | | 0.2% Yeild Strength (p.s.i.× 1000) | | % Elongation in 10" | | Electrical Conductivity (% IACS) | |
|---|---|---|---|---|---|---|---|---|---|
| Temp. ° C | Time Hrs. | A | B | A | B | A | B | A | B |
| 200 | 5 | 18.1 | 27.4 | 16.1 | 24.0 | 13.5 | 1.0 | 63.0 | 60.1 |
| | 24 | 16.4 | 25.2 | 13.2 | 22.7 | 22.2 | 1.1 | 63.3 | 60.3 |
| 225 | 5 | 16.1 | 22.6 | 13.4 | 20.7 | 19.4 | 1.6 | 63.1 | 60.4 |
| | 24 | 15.8 | 20.6 | 11.9 | 18.7 | 23.2 | 7.3 | 63.3 | 60.5 |
| 250 | 5 | 15.6 | 19.3 | 11.2 | 16.6 | 25.7 | 11.3 | 63.3 | 60.6 |
| | 24 | 15.2 | 18.1 | 10.1 | 14.7 | 28.4 | 15.2 | 63.3 | 60.6 |
| 275 | 24 | — | 16.8 | — | 12.0 | — | 18.2 | — | 60.7 |

It will be seen from these figures that the mechanical properties of Alloy B are markedly superior to those of Alloy A with only slight sacrifice in electrical conductivity.

The electrical contact behavior of the alloy of the present invention has been studied by means of the following test: Eleven short lengths of wire are held alternately crosswise in a vertical array, in a jig, and a predetermined load is applied to the junction point by a vertical plunger, thus pressing the wires into electrical contact. The plunger is then locked in position by grub screws so that not further movement is possible. The jig and plunger are electrically insulated from the stack of wires and the resistance between the two outer wires is measured. This method differs from some others that have been used in which the plunger is free to move and the load, usually dead weight, is applied continuously, so that as the specimens creep, the load is maintained at a constant level and the effect of creep is lost. With the plunger locked, however, the effect of creep can be measured as increases in electrical resistance due to the reduction in contact pressure, which is the situation obtained in practice.

Using this method, a wide variety of conditions can be simulated independently of the electric current, such as the effect on resistance of an applied load, of the temperature at the contact interfaces, and of time at which they are kept at elevated temperature. In all, there are 10 contact surfaces in series electrically, and the resistance can be measured after each particular treatment. A typical series of results are given in Tables 3 and 4 below, which list the measured values of the resistance across the 10 wire-to-wire contacts at 20° C. after the wire has been subjected to the various loads and to the indicated temperature for the indicated time. The designation H19 indicates that the wire is mechanically in the as-drawn condition having received at least 90% reduction in area during manufacture; H24 indicates a temper produced by partially annealing H19 wire in such a way that it loses about 60% of the difference in strengths between wire in the H19 and fully annealed tempers.

From these, the effect of creep in the commercially pure aluminum (Alloy A) will be noted. It will also be seen that this effect is much less in Alloy B. In the plated wires, while the effect of the creep is still apparent in Alloy A, it is undiscernible in Alloy B.

The effects of increasing the temperature at the contact interfaces are essentially that of relaxation of contact pressure, due to creep and softening of the alloy, and progressive oxidation of the contact faces. In these tests, the effect of differential thermal expansion is probably very slight since the support jigs were made of aluminum except for the short steel plunger. Also the temperature was applied uniformly, whereas in practice the heating effect of the current would be very non-uniform and would take effect chiefly in the aluminum conductor. Under such conditions, the effect of differential thermal expansion would probably be much greater.

It will be noted that the effect of exposure to elevated temperature is very large with Alloy A wires but is much less with Alloy B.

Table 3

Contact Resistance with Varying Load 0.081"-Diameter Wire

| Annelaing Treatment | | | | $^{R}$20° C in milliohms of 10 cross-contacts | | | | |
|---|---|---|---|---|---|---|---|---|
| | | | | Load in pounds | | | | |
| Alloy | Temp. ° C | Time Hrs. | Surface Condition | 20 | 40 | 60 | 80 | 100 |
| A | 205 | 6 | Cleaned* | 415 | 200 | 100 | 36 | 13 |
| | 205 | 6 | Cu-plated | 1.4 | 0.96 | 0.80 | 0.72 | 0.67 |
| | 250 | 24 | Cleaned* | 213 | 78 | 14 | 8.4 | 4.7 |
| B | 250 | 24 | Cu-plated | 7.4 | 2.7 | 1.3 | 1.3 | 0.97 |
| | 250 | 24 | Ni-plated | 4.0 | 1.7 | 1.2 | 1.0 | 0.78 |
| Copper | Annealed | | As-fabricated | 28 | 22 | 18 | 6.8 | 2.6 |

*Three minutes in hot 20% $H_2SO_4$ acid solution followed by rinse in cold water Table 4

Contact Resistance of 0.081" Diameter Wire after Various Treatments (75 lbs. Original Load)

| Annealing Treatment | | | | | $^{R}$20° C in milliohms of 10 cross-contacts after indicated exposure | | | | | | |
|---|---|---|---|---|---|---|---|---|---|---|---|
| Alloy | Temp. ° C | Time Hrs. | Corresponding Temper Designation | Surface Condition | 0 | 1 day 20° C | 4 day 20° C | 2h. 75° C | 2h. 100° C | 2h. 125° C | 2h. 150° C |
| | — | — | H19 | Cleaned* | 7.1 | 7.1 | 7.8 | 23 | 57 | 310 | 540 |
| A | 200 | 5 | H24 | Cleaned* | 7.6 | 8.7 | 9.4 | 11 | 14 | 26 | 73 |
| | 200 | 5 | H24 | Cu-plated | 0.80 | 0.80 | 0.80 | 0.88 | 0.97 | 2.5 | 5.6 |
| | 250 | 24 | H24 | Cleaned* | 3.9 | 5.2 | — | 5.6 | 6.3 | 7.9 | 8.1 |
| B | 250 | 24 | H24 | Cu-plated | 0.99 | 0.95 | — | 0.93 | 0.95 | 0.95 | 0.94 |

Table 4-continued

| Contact Resistance of 0.081" Diameter Wire after Various Treatments (75 lbs. Original Load) | | | | | | | | | | | |
|---|---|---|---|---|---|---|---|---|---|---|---|
| Annealing Treatment | | | | | $R_{20°}$ C in milliohms of 10 cross-contacts after indicated exposure | | | | | | |
| Alloy | Temp. ° C | Time Hrs. | Corresponding Temper Designation | Surface Condition | 0 | 1 day 20° C | 4 day 20° C | 2h. 75° C | 2h. 100° C | 2h. 125° C | 2h. 150° C |
| | 250 | 24 | H24 | Ni-plated | 1.1 | 1.1 | — | 1.1 | 1.2 | 1.3 | 1.4 |
| Copper | Annealed | | As fabricated | | 3.2 | 2.7 | — | 1.6 | 1.5 | 1.2 | 1.2 |
| Cu-clad | Annealed | | As fabricated | | 2.7 | 2.3 | — | 2.3 | 2.2 | 1.4 | 0.8 |

*Three minutes in hot 20% sulphuric acid solution

The validity of the above contact resistance tests was confirmed by connection tests performed according to Underwriters Laboratories Inc. (U.S.) recommendations for qualifying new alloys for use as building wire. In these tests, summarized in Table 5 below, fifteen Leviton Cat. No. 5320 (U.S. made) receptacles per alloy are wired with No. 12 aluminum wire with 6 inch-lb. torque and a current of 40 amps. is cycled (3½ hrs. ON — ½ hour OFF) in the circuit. These receptacles are generally conventional household wall outlets of the duplex type, i.e. having two sockets. The temperature rises (measured with thermocouples attached to the break-off straps of the receptacles) are recorded and readings of 175° C. or above are considered a failure. The test lasted for 500 cycles and 14 out of 15 receptacles wired with E. C. grade aluminum wire failed, while only one out of 15 receptacles wired with an alloy according to the present invention failed; that single failure occurred after 389 cycles. According to UL criteria, an alloy passes the test if no more than 3 receptacles failed during 500 cycles and if the surviving receptacles exhibit termination thermal stability. For the above tests, the surface of the wire samples is degreased but otherwise kept in the "as fabricated" condition.

TABLE 5

| CONNECTION PERFORMANCE IN UL-TYPE TEST | | | | | | | |
|---|---|---|---|---|---|---|---|
| Alloy No. | Receptacle No. | Average Temperature (° C) After Cycle No. 49 | 103 | 200 | 301 | 397 | 500 |
| EC | 1 | 99 | 108 | — | — | failed at | 141 cycles |
| | 2 | 98 | — | — | — | failed at | 102 cycles |
| | 3 | 90 | 94 | 100 | 105 | failed at | 320 cycles |
| | 4 | 99 | 110 | — | — | failed at | 107 cycles |
| | 5 | 94 | 97 | 96 | 100 | 104 | 107 |
| | 6 | — | — | — | — | failed at | 36 cycles |
| | 7 | 98 | — | — | — | failed at | 101 cycles |
| | 8 | 93 | 95 | 96 | 102 | failed at | 386 cycles |
| | 9 | 92 | 96 | 98 | — | failed at | 265 cycles |
| | 10 | 100 | 112 | — | — | failed at | 125 cycles |
| | 11 | 102 | — | — | — | failed at | 93 cycles |
| | 12 | 98 | — | — | — | failed at | 101 cycles |
| | 13 | 103 | — | — | — | failed at | 77 cycles |
| | 14 | 134 | — | — | — | failed at | 50 cycles |
| | 15 | — | — | — | — | failed at | 32 cycles |
| EC + Zr + Mg | 1 | 86 | 86 | 87 | 88 | 90 | 89 |
| | 2 | 84 | 84 | 84 | 83 | 84 | 84 |
| | 3 | 87 | 86 | 87 | 87 | 88 | 84 |
| | 4 | 90 | 90 | 91 | 91 | 92 | 89 |
| | 5 | 90 | 88 | 89 | 87 | 88 | 85 |
| | 6 | 89 | 90 | 90 | 88 | 90 | 90 |
| | 7 | 88 | 88 | 89 | 87 | 90 | 90 |
| | 8 | 84 | 84 | 85 | 85 | 86 | 84 |
| | 9 | 88 | 88 | 88 | 90 | 89 | 88 |
| | 10 | 90 | 89 | 90 | 94 | failed at | 389 cycles |
| | 11 | 90 | 90 | 90 | 92 | 92 | 89 |
| | 12 | 88 | 88 | 88 | 86 | 87 | 84 |
| | 13 | 88 | 88 | 89 | 86 | 88 | 88 |
| | 14 | 88 | 88 | 88 | 88 | 91 | 90 |
| | 15 | 94 | 94 | 94 | 95 | 96 | 96 |

The tensile creep resistance of Alloy A, Alloy B and copper are further illustrated by the following table 6.

Table 6

| Tensile Creep Resistance of Alloys A and B Compared with Copper (Room Temperature; 8,750 p.s.i. Stress; 0.081" Diameter Wire) | | | |
|---|---|---|---|
| | | Strain × $10^6$ after: | |
| Alloy | Condition | 1 hour | 1000 hours |
| A | Partial anneal 5 hours at 200° C | 61 | 360 |
| A | Partial anneal 24 hours at 250° C | —* | —* |
| B | Partial anneal 24 hours at 200° C | 30 | 140 |
| B | Partial anneal 24 hours at 250° C | 40 | 225 |
| Copper Annealed | | 46 | 220 |

*Too great an extension to be measured with equipment used in tests

An alloy such as Alloy B has similarly attractive mechanical and electrical properties when produced in the form of partially annealed rolled products, so that it finds application not only in the form of drawn wire for domestic wiring, other power conductors, and magnet windings, but also for strip such as is used in transformer windings where it is also important to use a conductor having good conductivity coupled with good stability on exposure to moderately high temperatures. For instance, Alloy B in the form of wire partially annealed for 24 hours at 225° C. had substantially stable properties after exposure for at least 100 hours at a temperature of 200° C. as may be seen from the following table of measured mechanical properties and electrical conductivity.

Table 7

| Stability of the Wire after Exposure to 200° C (The diameter of the wire was 0.081" and its surface condition was "as fabricated." All measurements were made at 20° C.) | | | | | |
|---|---|---|---|---|---|
| Original Annealing Treatment | Time (hrs) at 200° C | Ultimate Tensile Strength (p.s.i. × 1000) | 0.2% Yield Strength (p.s.i. × 1000) | % Elong. in 10" | Elec. Cond. (% IACS) |
| 24 hrs. at 225° C | 0 | 20.6 | 18.7 | 7.3 | 60.5 |
| | 5 | 20.5 | 18.0 | 9.2 | 60.6 |
| | 24 | 20.6 | 18.0 | 8.6 | 60.6 |
| | 100 | 20.4 | 17.8 | 9.5 | 60.7 |

In medium-size transformers, the operating temperature may be around 100° C. and, under short circuit condition, temperatures as high as 250° C. may be reached for a very short time. Hence, it is important that the aluminum windings retain their original strength upon long exposure at intermediate temperatures. An alloy according to the present invention meets these requirements as further evidenced by the following results:

Table 8

| Thermal Stability of an Alloy Containing 0.17% Mg and 0.04% Zr (0.295 in × 0.095 in. transformer strip) (Partial annealed 5 hours at 250° C) | | | | |
|---|---|---|---|---|
| Exposure time (hours) | Yield strength in p.s.i. × 1000 at room temperature after exposure at Temperature ° C | | | |
| | 175 | 200 | 225 | 250 |
| 2 | 15.9 | 16.1 | 16.2 | 15.3 |
| 24 | 16.1 | 16.3 | 16.2 | 14.2 |
| 100 | 16.2 | 16.0 | 15.7 | 13.2 |
| 1000 | 15.7 | 15.0 | 13.8 | 11.1 |
| 2864 | 15.4 | 14.9 | 12.7 | 11.0 |
| 5000 | 15.1 | 14.2 | 12.5 | 10.7 |

Both Zr and Mg have a strong depressive effect on electrical conductivity. When these elements are in solid solution in an aluminum alloy, an addition of 0.01% Zr reduces the conductivity by 0.38% IACS and an addition of 0.01% Mg reduces conductivity by 0.13% IACS. Therefore, it is important to control the content of these alloying elements, particularly Zr, to within very close limits to ensure a minimum conductivity of 60% IACS. The effect of variations of these two elements is shown by the following results:

Table 9

| Influence of Variations in Mg and Zr Contents (0.081 in. diameter wire - partial annealed 5 hours at 250° C)* | | | |
|---|---|---|---|
| Mg % | Zr % | 0.2% Yield Strength (p.s.i. × 1000) | Electrical Conductivity % IACS |
| 0.17 | 0.04 | 16.6 | 60.54 |
| 0.12 | 0.031 | 14.5 | 61.31 |
| 0.19 | 0.031 | 14.8 | 60.92 |
| 0.13 | 0.057 | 16.6 | 60.05 |
| 0.17 | 0.057 | 15.8 | 59.70 |
| 0.12 | 0.032 | 14.4 | 61.42 |
| 0.07 | 0.023 | 13.9 | 61.78 |
| 0.09 | 0.026 | 13.9 | 61.83 |
| 0.08 | 0.028 | 15.5 | 61.64 |
| 0.19 | 0.06 | 17.4 | 59.39 |

*A similar treatment on E.C. grade wire will result in annealed wire with a yield strength of about 8-9 ksi.

It is seen that with Zr up to 0.06% and normal Mg content, the conductivity remained below 60% and, therefore, the upper limit for Zr is 0.05%. This upper limit of the content of the relatively costly Zr addition is also economically advantageous. Similarly, a Zr content of 0.023 - 0.031% leads to a reduction of 2,000 to 3,000 p.s.i. in the yield strength for the given heat treatment. Lower Zr contents will give results barely higher than for normal E.C. grade aluminum wire. Hence the lower Zr limit is 0.02%.

A similar evaluation of various Mg contents, particularly from the point of view of creep resistance, has established that the minium Mg content is 0.07, while the maximum (for conductivity considerations) is 0.2%.

That is to say, the lower limits of Zr and Mg in accordance with the present invention are selected to ensure effective improvement in thermal stability and creep resistance, while the upper levels of Zr and Mg are critical for attainment of at least 60% IACS conductivity. Wire products of the present invention have wide application for such uses as household wiring (under conditions of normal room temperature) in which conventional E.C. grade aluminum wire has sometimes created very serious problems owing to failure of contacts.

It is to be understood that the invention is not limited to the features and embodiments hereinabove specifically set forth, but may be carried out in other ways without departure from its spirit.

We claim:

1. A method of making an electrical conductor comprising working an alloy consisting essentially of 0.07 - 0.2% Mg, 0.02 - 0.05% Zr, not more than 0.15% Si, not more than 1.0% Fe, not more than a minor amount of Cu, not more than 0.2% Zn, not more than 0,05% each of B and Ga, not more than 0.01% each of Ti, V, Mn and Cr, other elements not more than 0.03% each, 0.10% total, said minor amount of Cu not exceeding $[0.05 + 2(0.2 - m)]\%$ where $m$ is the percent content of Mg in said alloy, balance aluminum to produce a conductor, and annealing the produced conductor at a temperature between about 200° and about 300° C. for precipitating sufficient $ZrAl_3$ to impart to said conductor an electrical conductivity of at least 60% IACS.

2. An electrical conductor (a) constituted of an alloy consisting essentially of
  (i) 0.07 - 0.2% Mg,
  (ii) 0.02 - 0.05% Zr,
  (iii) containing not more than 0.15% Si, not more than 1.0% Fe, not more than a minor amount of Cu, not more than 0.2% Zn, not more than 0.05% each of B and Ga, not more than 0.01% each of Ti, V, Mn and Cr, other elements not more than 0.03% each, 0.10% total, said minor amount of Cu not exceeding $[0.05 + 2(0.2 - m)]\%$ where $m$ is the present content of Mg in said alloy, (iv) balance aluminum;

(b) said conductor being in a condition produced by annealing at a temperature between about 200° and about 300° C. for a period of time sufficient to precipitate $ZrAl_3$; and (c) said conductor having an electrical conductivity of at least 60% IACS.

3. A conductor as defined in claim 2, wherein the aluminum contains 0.05 - 0.60% Fe, not more than 0.10% Si, not more than 0.05% each of Cu and Zn, not more than 0.02% each of B and Ga, not more than 0.005% each of Ti, V, Mn and Cr, other elements not more than 0.01% each, 0.10% total.

4. A conductor as defined in claim 2, in a condition produced by annealing as aforesaid at a temperature of about 225° to about 275° C. for about 1 to about 24 hours.

* * * * *